US009109508B2

(12) United States Patent
Campbell

(10) Patent No.: US 9,109,508 B2
(45) Date of Patent: Aug. 18, 2015

(54) ACTION REACTION COMBUSTION ENGINE

(71) Applicant: Bob Campbell, Belleville, MI (US)

(72) Inventor: Bob Campbell, Belleville, MI (US)

( * ) Notice: Subject to any disclaimer, the term of this patent is extended or adjusted under 35 U.S.C. 154(b) by 0 days.

(21) Appl. No.: 14/254,665

(22) Filed: Apr. 16, 2014

(65) Prior Publication Data

US 2014/0326201 A1 Nov. 6, 2014

Related U.S. Application Data

(60) Provisional application No. 61/854,819, filed on May 3, 2013.

(51) Int. Cl.

| | |
|---|---|
| ***F02B 75/24*** | (2006.01) |
| ***F02B 33/06*** | (2006.01) |
| ***F02B 75/28*** | (2006.01) |

(52) U.S. Cl.

CPC ..... *F02B 75/24* (2013.01); *F02B 33/06* (2013.01); *F02B 75/28* (2013.01)

(58) Field of Classification Search

CPC ..... F02B 75/24; F02B 75/246; F02B 75/26; F02B 75/28

USPC ..... 123/53.3, 53.6, 58.1

See application file for complete search history.

(56) References Cited

U.S. PATENT DOCUMENTS 7,721,687 B1 * 5/2010 Lockshaw et al. ..... 123/52.1

* cited by examiner

*Primary Examiner* — Lindsay Low
*Assistant Examiner* — Kevin Lathers

(57) ABSTRACT

An action reaction combustion engine comprising of one or more engines with one or more pistons having adequate mass being housed in mated cylinders and having two opposing heads also having valving plumbing fuel delivery and starting means and allowed to reciprocate on linear bearings delivering a workforce on each end of back and fourth stroke one force when the pistons compresses and stops and one force when fuel ignites or high pressure air pushes and drives the piston back producing four power events every one complete reciprocating cycle or revolution of the crank or other drive mechanism.

4 Claims, 5 Drawing Sheets

9
3
5
1
7
12
14
8
2
4
13
10
6
15
11
16

ACTION REACTION COMBUSTION ENGINE

CROSS REFERENCED TO RELATED APPLICATION

This application claims the benefit of U.S. provisional patent application No. 61/854,819 filed May 3, 2013 titled action reaction combustion engine.

BACKGROUND OF THE INVENTION

This invention has to do with internal combustible fuel burning reciprocating engines. There are several applicable types of U.S. patent classifications for this application, such as internal combustion engines where mechanical power is needed for various uses.

All internal combustion engines to date are very inefficient where a big portion of the heat energy is wasted and not effectively doing all the work that it could be doing (100% input with 20-30% output).

The wasted heat energy has to be carried away by a radiator or other means of cooling, the heat and pressure in a combustion chamber is the highest when the crank and piston's position is at top dead center. That is when the engine's piston and crank can do no work, driving the heat into the head and piston. The energy has no place to go.

As the crank moves down and starts to gain a mechanical advantage the pressure in that cylinder continuously drops off.

We have been making engines this way for about 150 years, and for most engines there is only one power stroke every forth cycle, every two revolutions of the crank, and very little change has been made in the design since the beginning of the internal combustion engine. We have used this same engine design for a long time.

BRIEF SUMMARY OF THE INVENTION

This invention uses the theory of action reaction. The energy and forces it takes to stop a mass in motion as well as the energy and forces it takes to accelerate it again and its ability to do work with those forces are the bases of my invention.

This invention uses the engine's reciprocating motion and the energy and forces that this motion produces by starting and stopping the mass of the pistons to turn a crank flywheel drive shaft pump or other type of drive mechanisms.

This technology is not new, but has never been used in the application for a combustion engine.

When the energy and forces that are applied to a crank are as close as possible to 90 degrees after top dead center is when the mechanical advantages are at their optimum. That is exactly what this engine will accomplish.

Not only does it gain a 90 degree mechanical advantage, but it also delivers four power events every reciprocating cycle or revolution of crank, two events when the mass stops on each opposite end and two when the mass reverses direction and starts the mass moving again on each opposite end.

The engine pushes and pulls the crank in both directions, but does so with a very simple design and few moving parts. It will burn most any kind of fuel and will be very efficient.

DESCRIPTION

Figure 1:
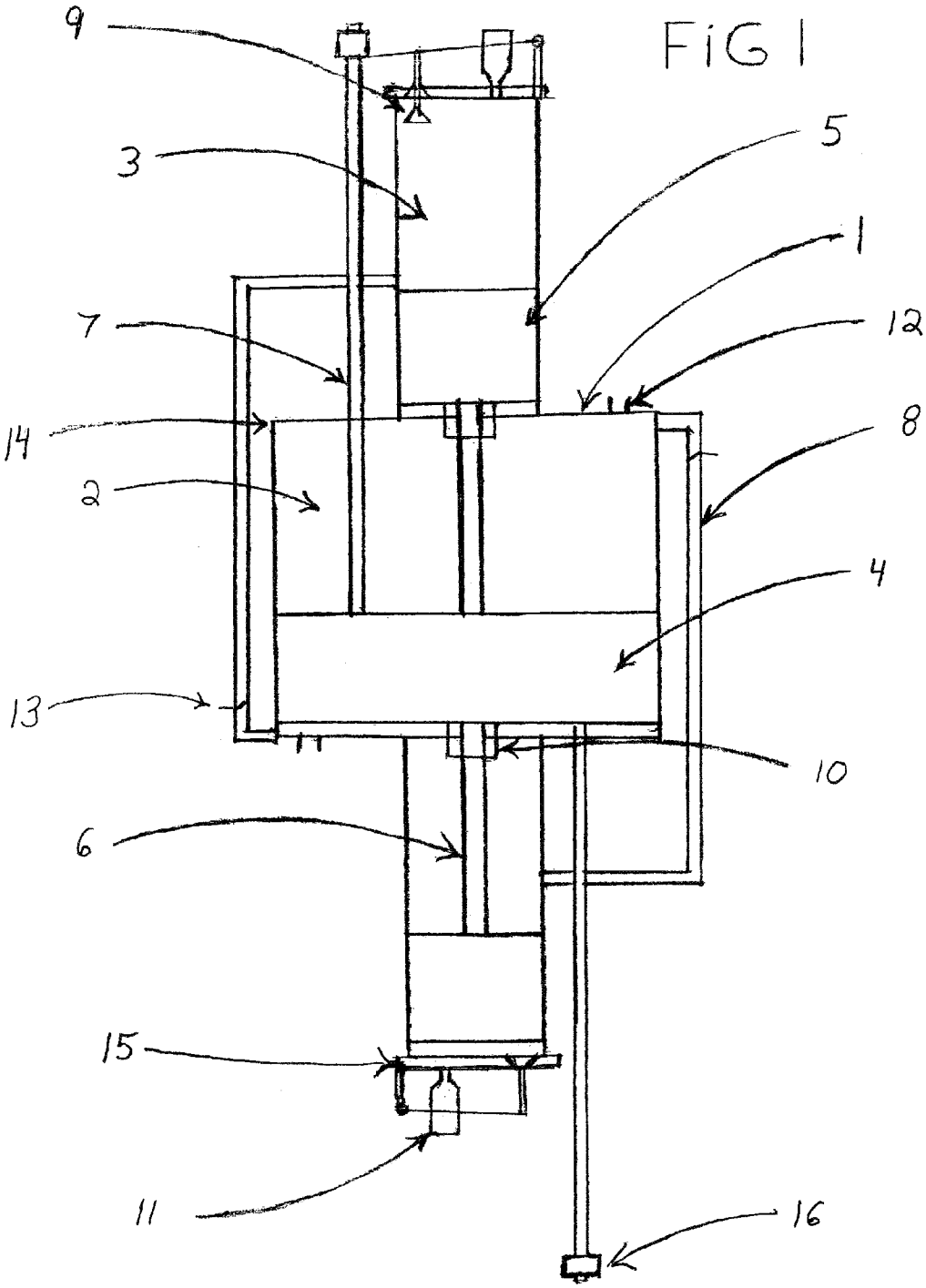
FIG. 1 depicts most of the descriptive parts of the main embodiment.

An action reaction free piston combustion engine composed of one or more said engines connected to a crank or other drive mechanism consisting of one or more pistons and cylinders.

Said engines with three or more said pistons traveling together and being attached by rods and are allowed to reciprocate.

The two smaller said pistons on each end and the one large heavy said piston in the center are moveable and mated to their perspective said cylinders separated by two bulkheads. The said rods and said pistons are supported by lineal bearings.

The said lineal bearings being mounted in said bulkheads and said pistons having adequate mass to produce action reaction necessary to push and pull said engine and said engine is allowed to reciprocate on said lineal bearings against a workload like a crank to transmit energy, and that energy into work.

DETAILED DESCRIPTION OF THE INVENTION

I have numbered every part at least once with out numbering them twice where opposing parts are identical and obvious, the engine will always be referred to as the number 1. To begin in FIG. 1 the major parts for said engine 1 being an example of a three cylinder engine include one cylinder 2 in the center and two cylinders 3 on opposing ends of said engine 1 along with opposing cylinder heads 15 being fastened together with fastener means 20 in FIG. 5.

The three said cylinders of said engine 1 in FIG. 1 being fitted with three pistons, one large center said piston 4 and two smaller end said pistons 5 and are movable in and mated to their perspective said cylinders 2 and 3 and are allowed to reciprocate freely in said cylinders 2 and 3, compressing and firing on one end while the other end is exhausting.

The said pistons 4 and 5 are attached together by rods 6 if applicable running through bulkheads 14 for separating said pistons 4 and 5 and said cylinders 2 and 3.

Said pistons 4 and 5 are supported by lineal bearing means 10 that are mounted in said bulkheads 14.

Figure 5:
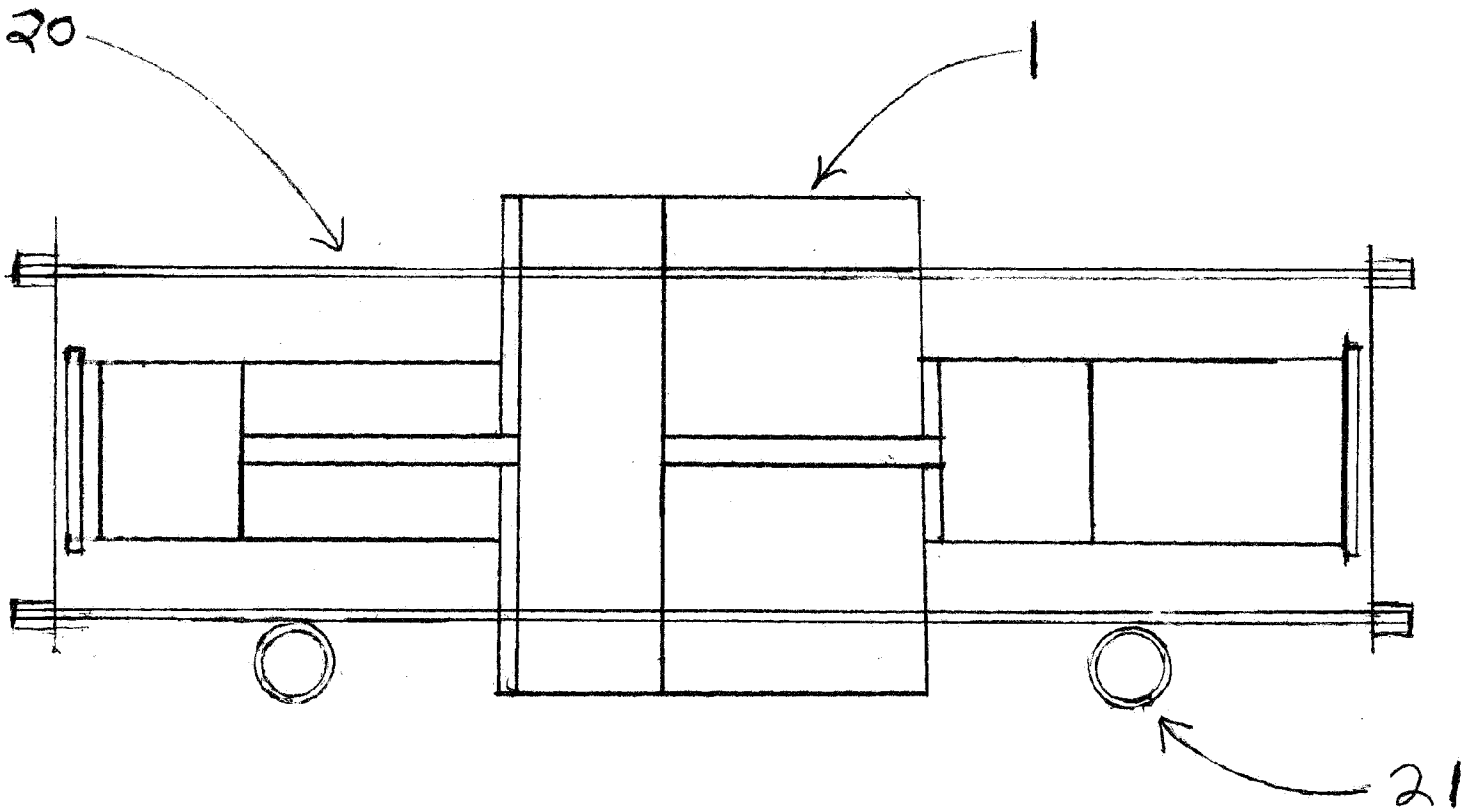
FIG. 5 depicts the engine supported by bearings and being fastened together with fasteners.

Said pistons 4 and 5 are allowed to reciprocate in their perspective said cylinders 2 and 3. Said pistons 5 are allowed to compress against the said cylinder heads 15 in turn pushing and pulling said engine 1 backward and forward while riding on said bearing means 21 as depicted in FIG. 5 and producing a work force.

The valving control rods 7 and valve adjusters 16 in FIG. 1 are for timing the exhaust valves 9, letting the exhaust out through said valves 9 mounted in said cylinder heads 15.

Plumbing means in FIG. 1 consisting of tubes 8 connected between said cylinders 2 and 3 with check valves 13, located in said tubes 8 and taking out side air in through one way valves 12 where air is drawn in to said cylinder 2 and then compressed and sent through said tube 8 and past said check valve 13 into said cylinder 3 that is in position to exhaust and that said cylinder 3 is then purged out through said valve 9 for that end of said engine 1.

As one end of said engine 1 in FIG. 1 is exhausting out through said valve 9 in said cylinder head 15, the other end of said engine 1 is firing by means of a timed fuel injector 11 located in the end of said cylinder head 15, and the cycle repeats firing on one end and exhausting on the other.

Figure 2:
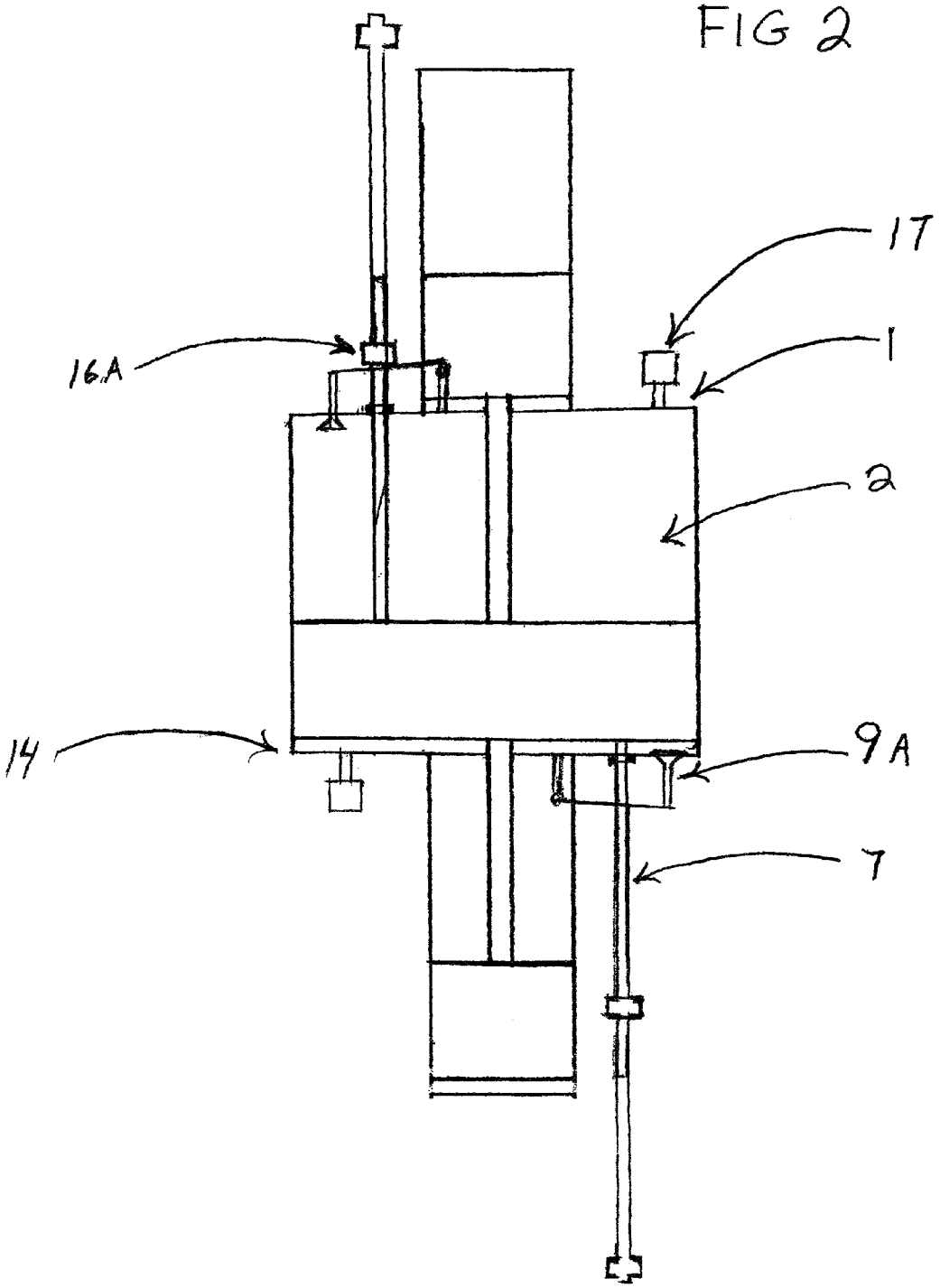
FIG. 2 depicts the valving and valving control for adjusting exhausting air and air inlet valving for controlling air intake for starting and or running on air.

FIG. 2 drawing is a example of said engine 1 as the starter and an air engine where the air inlet valves 17 are properly timed to let high pressure air into said cylinder 2 and the air pressurizing said cylinder 2, and applying high pressure air between said piston 4 and said bulkhead 14, pushing said bulkhead 14 and said piston 4 apart, and pushing said bulkhead forward and said piston 4 backward causing said engine 1 to reciprocate producing a action reaction.

While said piston 4 is pressurizing and pushing one end of said engine 1 in FIG. 2, exhausting is taking place simultaneously on opposite end of said cylinder 2 of said engine 1 and exhausts out through valve 9A, and said valve 9A, being timed by said valving control rod 7 and valve adjuster 16*a*. So said piston 4 and said engine 1 now becomes a starter as well as air engine starting the said combustion engine 1 as well as to assist in the over all output of the said combustion engine 1.

Figure 3:
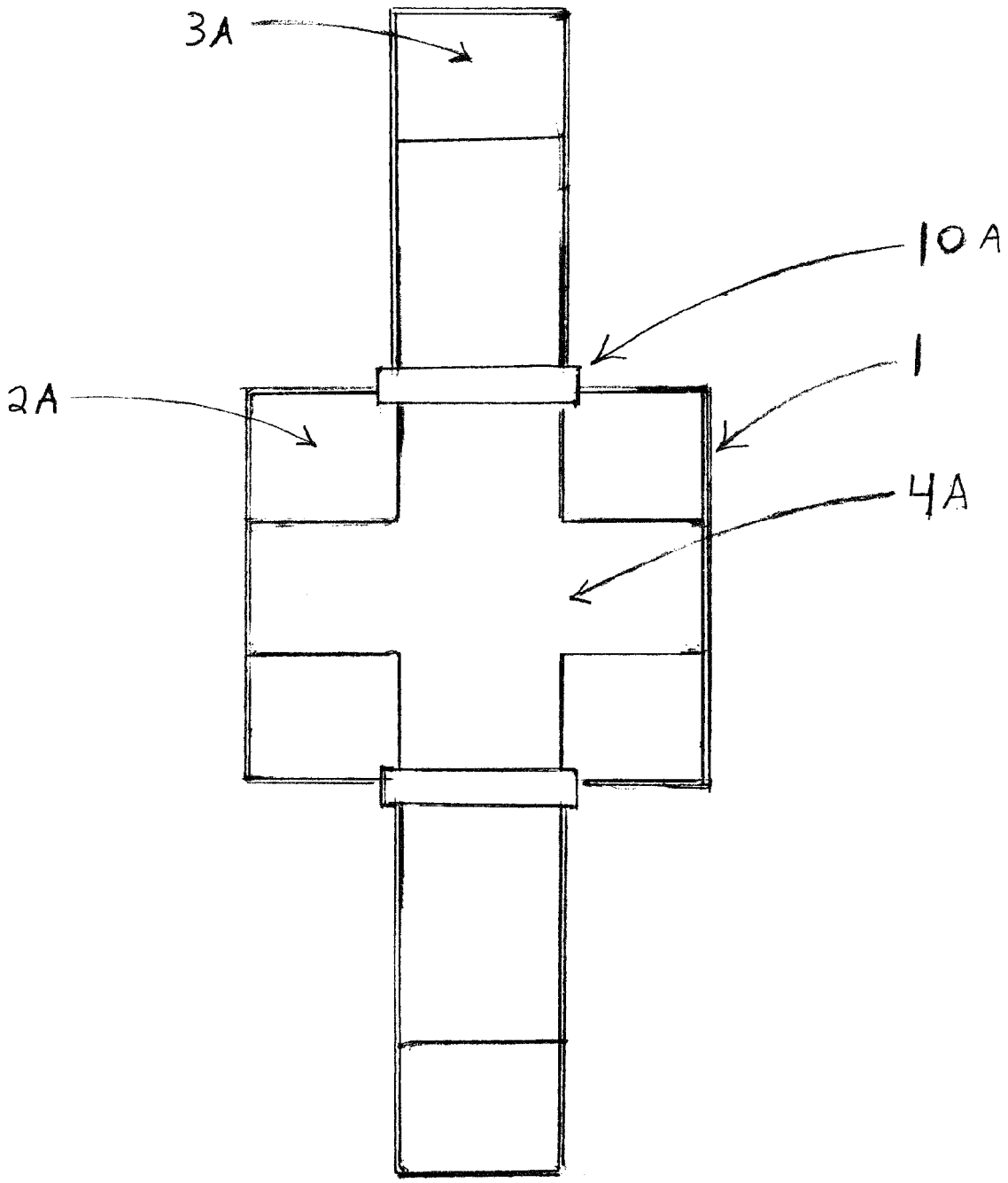
FIG. 3 depicts the engine as a one-piston engine having separable cylinder.

FIG. 3 is a drawing of said engine 1 having only one piston 4*a*, and being of one piece with a larger center portion and having adequate mass and being movable and housed in cylinder 2*a* and said cylinder 2*a* being separable.

Each end of the said piston 4*a*, FIG. 3 which is the two outboard ends of said piston 4*a* and being housed in said cylinders 3*a* which is the outboard end of said cylinder 2*a* and said piston 4*a* being slidable in lineal bearing means 10*a* and said piston 4*a* being allowed to reciprocate.

Said engine 1 in FIG. 3 having same parts including said valves 9 and said valve adjusters 16, said cylinder heads 15, and said plumbing means consisting of said tubes 8 with said check valves 13 and said fuel delivery injectors 11 as in said engine 1 in FIG. 1 except said lineal bearing means 10*a*, being in drawing for said engine 1 FIG. 3 and as well as the same said engine starting means as in said engine 1 FIG. 2, and having same said bearing means 21 as in FIG. 5.

Figure 4:
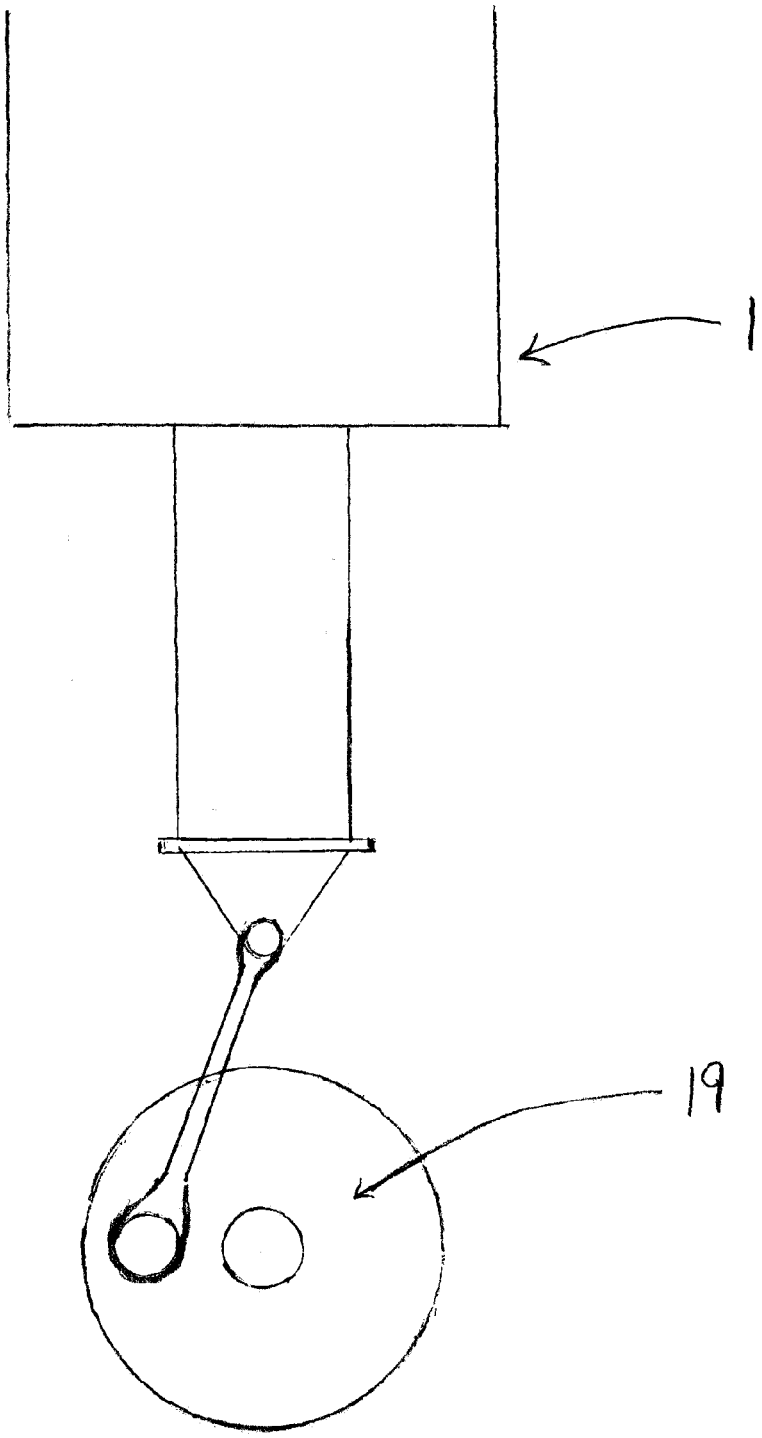
FIG. 4 depicts the engine attached to a crank.

And said engine 1 of FIG. 3 being attached to same said crank 19 or other said drive mechanism as in said engine 1 FIG. 4.

FIG. 4 is a drawing of said engine 1 in FIG. 1, FIG. 2, and FIG. 3 being connected to said crank 19 in FIG. 4 and said engine 1 is allowed to reciprocate on said bearing means 21 in FIG. 5 and turning said crank 19 in FIG. 4, producing a force against a workload.

The drawing in FIG. 5 shows said engine 1 mounted on said bearing means 21 and allowed to reciprocate and is fastened together with said fastener means 20.

The invention claimed is:

1. An action reaction combustion engine comprising:

a plurality of pistons disposed within a corresponding plurality of cylinders wherein a center piston and cylinder of the plurality of pistons and cylinders is larger than other pistons and cylinders of the plurality of pistons and cylinders and said larger piston works as an air pump;

each piston being slideably disposed within a corresponding cylinder;

each of the others cylinders having two opposing cylinder heads containing valving;

a means for fuel delivery to the other cylinders;

air intake plumbing wherein the other pistons compress against the cylinder heads a fuel air mixture which is then combusted pushing the others pistons and the cylinder heads apart producing a work force; and the plurality of pistons and cylinders being held and supported in stationary frames by frame bearings;

the plurality of pistons and cylinders reciprocate on said frame bearings within said frames and are attached to one of a crank, a drive mechanism, and a pump which is operated by the transfer of reciprocating motion from the plurality of pistons and cylinders.

2. The action reaction combustion engine of claim 1, wherein the plurality of pistons and cylinders have separating bulkheads between cylinders through which the piston rods pass and are held by rod bearings.

3. The action reaction combustion engine of claim 1, wherein the plurality of pistons are constructed as one piece disposed within the plurality of cylinders and are separable from said cylinders.

4. The action reaction combustion engine of claim 1, further the action reaction engine starting and running on one of compressed air and combustion.

* * * * *